United States Patent [19]

Mitchell

[11] 4,058,210

[45] Nov. 15, 1977

[54] TOOL CASE

[76] Inventor: William J. Mitchell, Rte. 695, Trevilians, Va. 23170

[21] Appl. No.: 723,106

[22] Filed: Sept. 14, 1976

[51] Int. Cl.[2] ..... B65D 85/28; B65D 25/28

[52] U.S. Cl. ..... 206/372; 312/DIG. 33; 220/94 R

[58] Field of Search ..... 206/372–378; 312/DIG. 33; 220/DIG. 10, 94 R, 244

[56] References Cited

U.S. PATENT DOCUMENTS

| | | | |
|---|---|---|---|
| 1,597,092 | 8/1926 | McTighe | 206/373 |
| 2,880,918 | 4/1959 | Schweikhard | 206/373 |

FOREIGN PATENT DOCUMENTS

| | | | |
|---|---|---|---|
| 909,887 | 3/1954 | Germany | 206/DIG. 33 |

*Primary Examiner*—William Price
*Assistant Examiner*—Douglas B. Farrow
*Attorney, Agent, or Firm*—John C. Smith, Jr.

[57] ABSTRACT

A portable tool case having a handle mounted for vertically sliding movement relative to the body of the case. Dual lid sections are hinged to the upper edges of opposing sides. When the lids are closed, and the handle placed in its lower position and locked, it abuts against the lids and prevents them from opening. Special storing and securing means for tools and equipment are provided within the case.

9 Claims, 6 Drawing Figures

TOOL CASE

BACKGROUND OF THE INVENTION

This invention relates generally to tool cases and more specifically to portable tool cases which are used by carpenters and the like.

There are many types of tool cases on the market today which are, in varying ways, provided with some type of means for carrying the different pieces of equipment which are required by the tradesman using the case. One of the problems with such portable cases is to provide a means for properly carrying the case while being assured that it will not accidently be opened while being transported from place to place. It is quite obvious that a sudden opening will scatter the tools and possibly damage many of the more delicate pieces of equipment which are required.

Another problem with known tool cases is a provision for keeping all of the tools and equipment securely stored and, yet placed conveniently so that they are readily accessible as well as easily removable when the time for use occurs.

BRIEF DESCRIPTION OF THE INVENTION

Accordingly, it is an object of the present invention to provide a tool case for carpenters and the like wherein the handle for carrying the case also acts as a means for locking the lids on the case in a closed position for holding them securely in that position while the case is being transported from one place to another.

A further object of the invention is to provide a tool case wherein the available space is used in a most efficient manner by providing specific means for holding specific tools and at the same time providing easy access to these tools.

These and other objects of the invention will become apparent from the following description of the invention.

DETAILED DESCRIPTION OF A PREFERRED EMBODIMENT OF THE INVENTION

Figure 1:
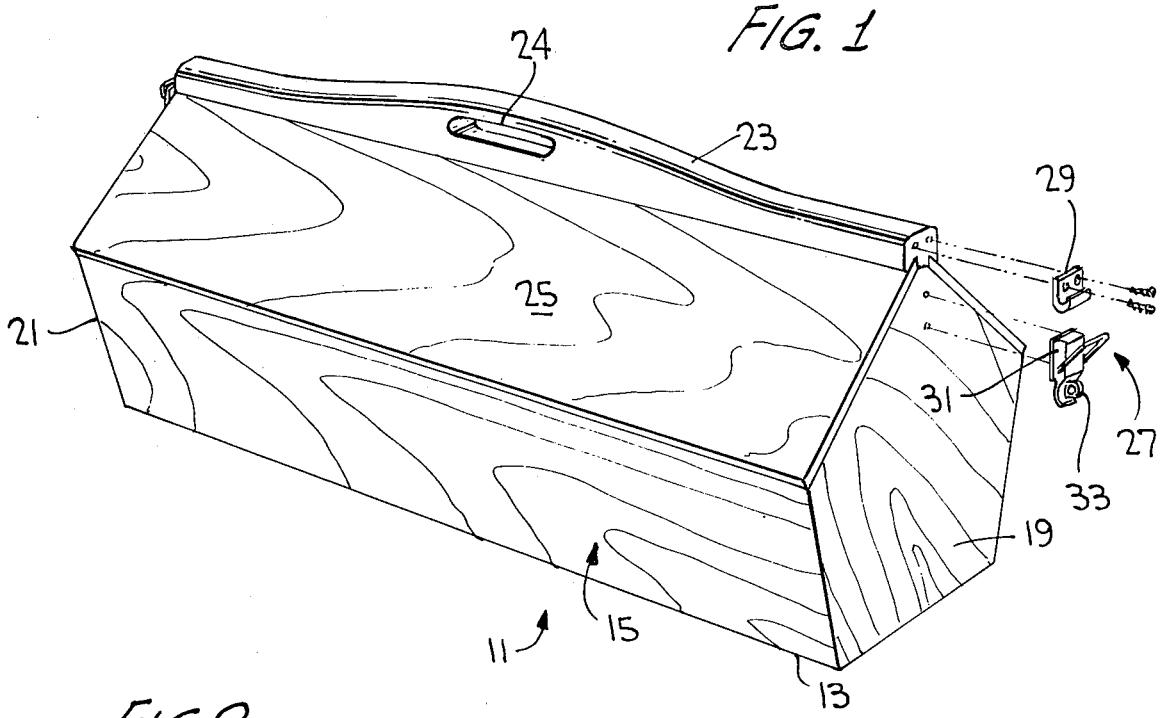
FIG. 1 is a perspective drawing of a preferred embodiment of the tool case of the present invention including an exploded view of the latching mechanism.
Figure 2:
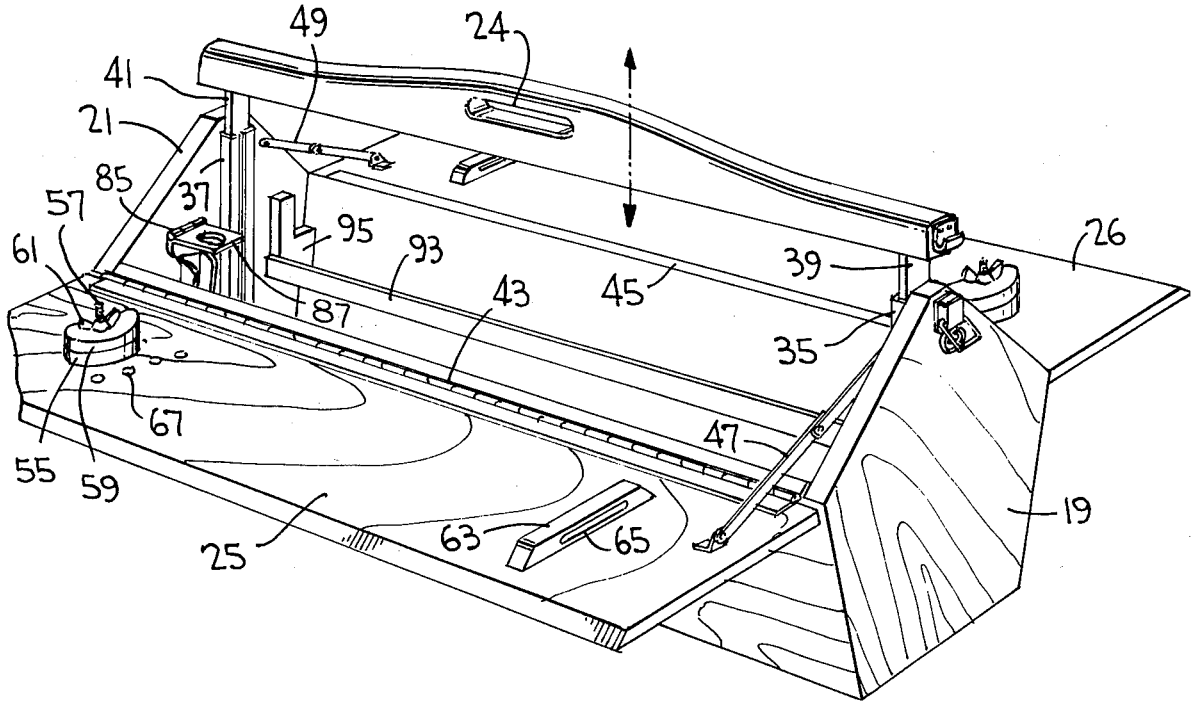
FIG. 2 is a perspective view of the box of FIG. 1 with the lids of the case in their open position.

Referring now to FIGS. 1 and 2, there is shown a preferred configuration of the tool case 11 of the present invention. The box has a base 13 with sides 15 and 17 and end sections 19 and 21. There is further provided a handle section 23 extending across the entire length of the case which includes a hand hole 24. Two lid sections 25 and 26 are also provided to cover the case.

As indicated in FIG. 1, when the case is in its closed position, a latching mechanism 27 is provided in order to secure the handle to at least one of the end sections 19. The latch is of a known available configuration and includes a solid lip section 29 which is mounted on the end of the handle 23 and a mating hinged section 31 which is mounted on the end section 19. The device may contain a loop 29 through the section 31 in order that a padlock may be secured thereto.

Figure 6:
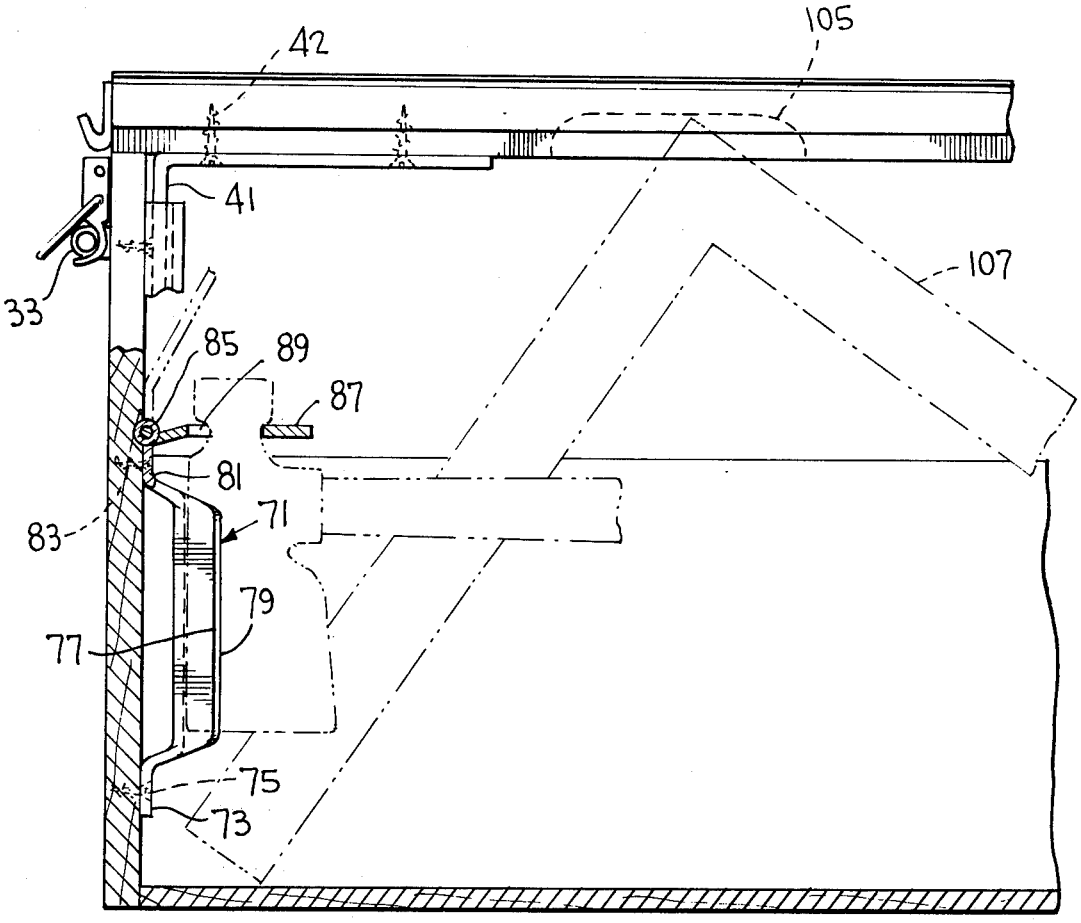
FIG. 6 is a partial sectional view of one end of the case of FIG. 1.

The tool case is shown in its open configuration in FIG. 2. In order to provide the mating and locking of the handle 23 with the tool case body, there is provided at either end thereof channels 35 and 37 which are vertically secured substantially centrally on the inner faces of each of the end sections 19 and 21. A pair of rigid legs 39 and 41 are secured to the underside of the handle 23, as shown in FIG. 6, and are so placed as to mate with their respective channels 35 and 37. This allows the handle to move up and down vertically since the legs 39 and 41 are free to slide within the channels 35 and 37.

The two lid sections 25 and 26 are hinged along the entire lengths of the upper edges of sides 15 and 17 by means of standard type hinges 43 and 45. The extent to which the lids may drop outwardly is limited by means of the hinged support arms 47 and 49 which maintain the lids in the desired open position.

Figure 4:
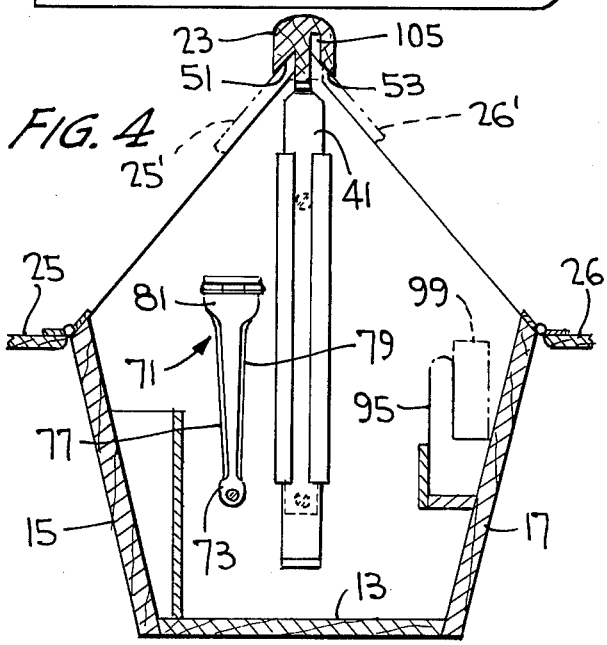
FIG. 4 is a sectional view taken along the lines 4—4 of FIG. 3.

With reference to FIG. 4 it can be seen that the under side of the handle 23 is cut so as to provide shoulders 51 and 53. The reason for providing these shoulders is indicated with the phantom line showing of the sides 25′ and 26′ in a closed position. When the lids are closed, the handle is lowered until the shoulders 51 and 53 abut against the free ends of the lids. This is the position basically shown with the handle in its closed position in FIG. 1. Accordingly, when in that position, and with the latching mechanism locked, the handle not only provides a means for carrying the case, but also provides a means for locking the lids closed.

Figure 3:
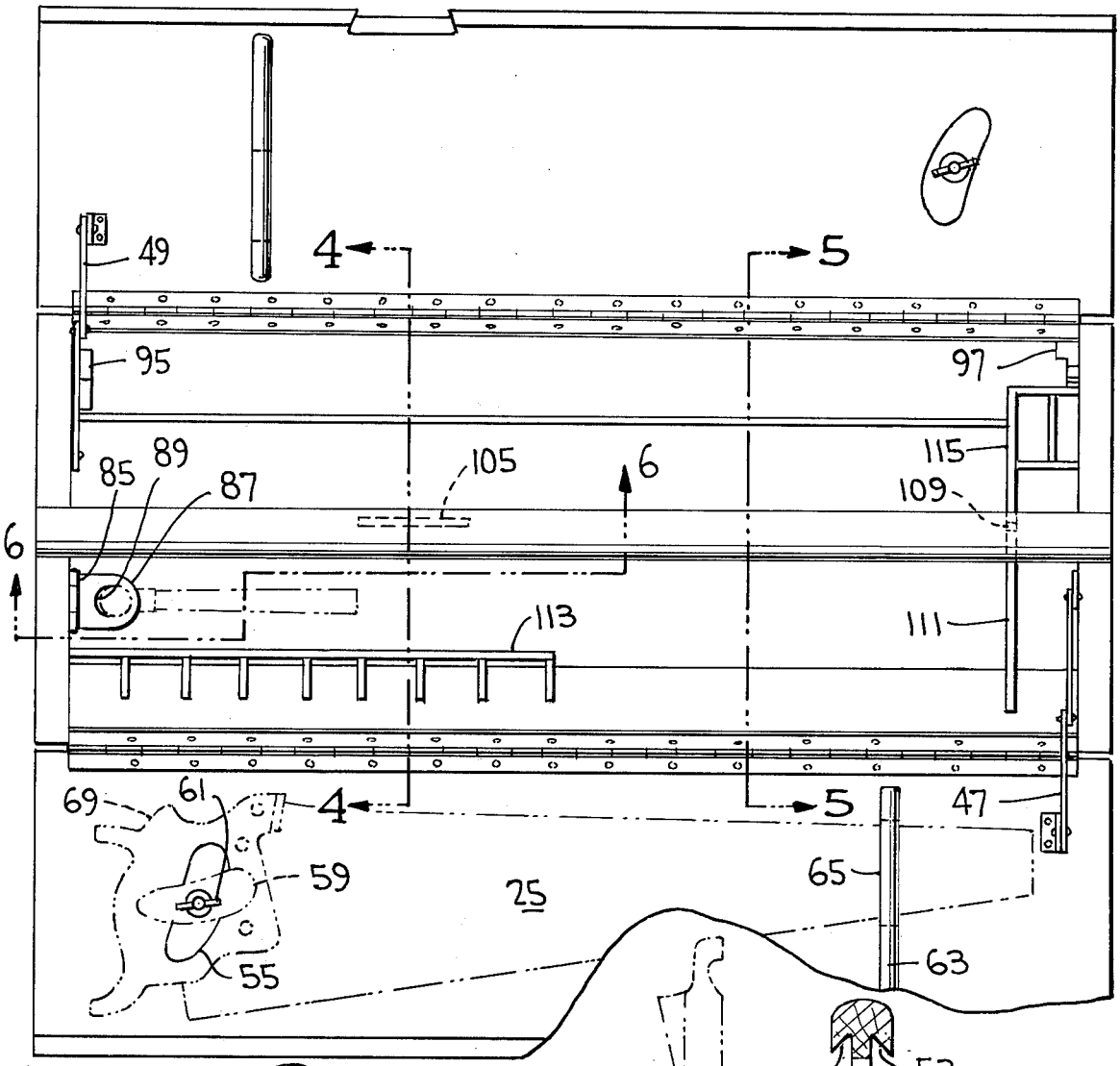
FIG. 3 is a partial plan view of the open box of FIG. 2.

Means may also be provided on the inside of either lid for storing hand saws in an easily accessible and removable position within the case. A wooden block 55 is secured to the inside of the lid 25 near one end thereof by means such as an adhesive. The block is in a configuration which mates with the standard hand hole of the saw handle 69. A threaded bolt 57 extends upwardly from within block 55. A similar solid block 59 is removably placed over bolt 57. As shown in FIG. 3, the saw is placed over the fixed block 55 and the removable block 59 is placed in a position so as to be at an angle to the fixed block, and is subsequently secured tightly against the saw handle by wing nut 61 which mates with the bolt 57. The other end of the saw passes thru a slot 65 in a wooden panel 63 which is also secured to the lid 25 near the other end thereof. This construction provides for a secure, thightly held saw, while still providing easy access and removal of the saw when use thereof is required. The same means may be provided on the opposite lid for a saw having a different cut.

There is further provided within the box a means for securely holding a chopping tool such as a button-head hatchet. Referring to FIGS. 2 and 4, a hatchet holder 71 is secured to the end section 21 of the tool case by means of screws or the like. The hatchet holder 71 has a flattened lower section 73 which is secured to the section 21, and upwardly extending parallel walls 77 and 79. The upper end of hatchet holder 71 terminates in another flat section 81 which also may be secured to the end section 21. A plate 87, having a hole 89 therein, is secured to the upper end of hatched holder 71 by means of a hinge 85. When the hatchet is in place, as indicated in FIG. 3, the plate 87 is lowered so that the hole 89 passes over the button head of the hatchet.

Thus, the weight of the hatchet provides its own secure position against the plate 87 and within the parallel walls 77 and 79. It also is easily removable by simply tilting the hatchet slightly, and raising the plate 87.

Figure 5:
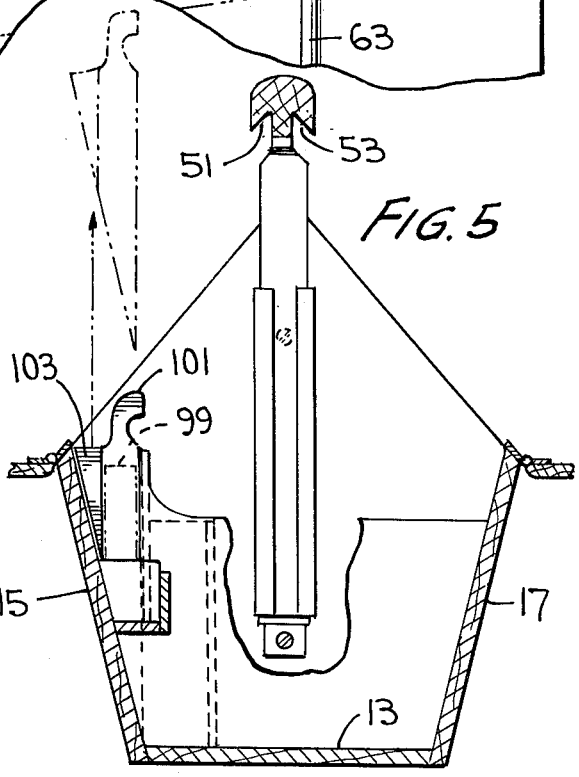
FIG. 5 is a sectional view taken along lines 5—5 of FIG. 3.

The opposite side of the case is fitted with a channel 93 which provides a space for various small items such as boxes of nails, screws and the like. At either end of this channel, L-shaped blocks 95 and 97 are secured to opposite ends 19 and 21 of the case. These blocks are designed so as to provide a support for either end of a carpenter's level 99 as shown more clearly in FIG. 4. Since the sides 15 and 17 of the case are tilted at slightly outward angles, there is further provided a wedge 101, FIG. 5. This wedge has an extending section 103 with one side having an angle to match the angle of the side section 15 and cut at its other side so as to provide as substantially vertical bearing surface. Accordingly, when this wedge is placed in position as shown in FIG. 5 it serves to securely bind the carpenter's level 99 in position so as to prevent damage thereto when the case is moved.

Referring now to FIG. 6, there is shown in phantom a notch 105 in handle 23 which is located so as to accept the outer angular corner of the carpenter square when the handle is in its lower position. The other end of the carpenter square passes thru a notch 109 within a cross wall 111.

The case is also provided about its interior periphery with various selected compartments 113 and 115. Compartments 113 are specifically useful for holding various sized chisels.

As can be seen, the present invention provides a tool case with specific locations for various tools which are securely held and easily accessible. Also provided are compartments sections for smaller tools and other pieces of hardware. All of these are so arranged that the interior of the box still provides a large space for any extra equipment which may be required.

Of particular value is the locking feature provided by the vertically slidable handle in relation to the case itself and the hinged dual lids. Such a dual feature provides a case having a compact carrying and locking feature. Additionally, the shoulders along the underside of the handle provide a weatherproofing function when the handle is in the locked position.

It is to be understood that the above description and drawings are illustrative only since equivalent parts could be substituted without departing from the scope of the invention which is to be limited only by the following claims.

I claim:

1. A tool case comprising
base, sides and end sections secured together;
lid sections hinged at one edge thereof to the upper edges of said side sections;
a handle;
means for slidably mounting said handle for vertical movement relative to said base;
said handle abutting the free edges of said lids when said lids are closed and said handle is in the lowermost position; and
means for releasably securing said handle to at least one of said end sections when said handle is in its lowermost position.

2. The tool case of claim 1 further comprising
means on the inner face of at least one of said lids for removably securing a handsaw thereto.

3. The tool case of claim 1 further comprising
a slot in the underside of said handle for receiving the outer corner edge of a carpenter square when said handle is in its lowermost position.

4. The tool case of claim 1 further comprising
a channel secured adjacent to the inside of one of said side sections for holding a carpenter's level; and
a removable wedge for securing said level within said channel.

5. The tool case of claim 1 further comprising
a slotted member for receiving the upper edge of a button-head hatchet; and
a ring member hinged to the upper edge of said slotted member for passing over the head of said hatchet.

6. The tool case of claim 1 further comprising
a plurality of compartments mounted adjacent said wall and end sections for storage of small tools and hardware.

7. The tool case of claim 1 wherein said handle comprises
an upper section extending substantially centrally above and along the length of said case;
shoulders on either side of said upper section extending outwardly and downwardly so as to cover the outer edges of said lids when said handle is in its lowermost position.

8. A tool case comprising
a substantially rectangular base
opposed walls extending upwardly from said base;
end panels secured between said base and walls;
lid sections hinged to opposite upper edges of said walls so as to open outwardly;
a handle extending substantially centrally above and along the length of said case;
shoulders on either side of said handle;
opposed channel members vertically secured substantially centrally to the inside face of each of said ends;
a pair of rigid legs secured to and depending from said handle, said legs being positioned on said handle so as to slidably mate with said channels;
means shoulder means abutting against the free ends of said lids when said lids are in a closed position and said handle is secured to said end section.

9. A tool case comprising
a compartment having base, sides, end sections and lid sections hinged at one edge thereof to the upper edges of said side sections;
a handle;
means for slidably mounting said handle for vertical movement relative to said base between lower and upper positions;
said handle abutting the free edges of said lids when said lids are closed and said handle is in said lower position; and
means for releasably securing said handle to said compartment when said handle is in said lower position.

* * * * *